US008807829B2

(12) United States Patent
Mong

(10) Patent No.: US 8,807,829 B2
(45) Date of Patent: Aug. 19, 2014

(54) WATCH WITH REPLACEABLE DECORATING ELEMENT

(75) Inventor: Anthony Wai Hung Mong, Hung Hom (HK)

(73) Assignee: Art's King Company Limited, Kowloon (HK)

( * ) Notice: Subject to any disclaimer, the term of this patent is extended or adjusted under 35 U.S.C. 154(b) by 302 days.

(21) Appl. No.: 13/447,525

(22) Filed: Apr. 16, 2012

(65) Prior Publication Data

US 2013/0272103 A1 Oct. 17, 2013

(51) Int. Cl.
*G04B 37/00* (2006.01)
*G04B 37/14* (2006.01)

(52) U.S. Cl.
CPC ..... *G04B 37/1486* (2013.01)
USPC ..... 368/281; 368/282

(58) Field of Classification Search
CPC ..... G04B 37/1486; A44C 5/00
USPC ..... 368/88, 281, 282, 294, 295, 309, 310; 224/164, 219
See application file for complete search history.

(56) References Cited

U.S. PATENT DOCUMENTS

| | | | | | |
|---|---|---|---|---|---|
| 3,492,809 | A | * | 2/1970 | Gisiger-Lusa | 368/282 |
| 4,034,552 | A | * | 7/1977 | Davidson | 368/280 |
| 4,167,850 | A | * | 9/1979 | Schneider | 368/282 |
| 4,769,799 | A | * | 9/1988 | Matsukage | 368/278 |
| 5,065,376 | A | * | 11/1991 | Choulat | 368/282 |
| 5,631,879 | A | * | 5/1997 | Pequignet | 368/282 |

* cited by examiner

*Primary Examiner* — Vit W Miska
(74) *Attorney, Agent, or Firm* — Raymond R. Ferrera; Adams and Reese LLP

(57) ABSTRACT

A watch comprises a body and a strap with a first through hole. A decorating substrate with a second through hole is provided on an upper surface of the strap and a snap ring is provided below a lower surface of the strap, in which the decorating substrate and the snap ring are attached correspondingly with the first through hole. The body is installed into the first and second through holes. An upper surface of the body comprises an extending edge which is attached on an upper edge of the second through hole in the decorating substrate. The body further comprises a bottom end extending through the first through hole. The bottom end of the body is provided with an external thread. The snap ring forms a thread connection with the bottom end and is attached below a lower edge of the first through hole in the strap.

5 Claims, 5 Drawing Sheets

WATCH WITH REPLACEABLE DECORATING ELEMENT

FIELD OF THE PRESENT DISCLOSURE

The present disclosure relates to watches which are normal articles for daily use, more particularly to a watch having replaceable decorating element.

BACKGROUND OF THE PRESENT DISCLOSURE

It is well-known that a watch comprises a body and a strap. The body is a main functional element in a watch, in which an electrical movement, a mechanical movement, or a quarter movement is installed. An outside surface of the body is provided with a display window to show time. The body is connected with the strap. Users may wear watches by wrapping the strap on their wrists, thus providing the user a convenience of carrying on the watch.

In the present time, a watch is more than a time tool. It has been much more often used as an ornament. Even in a world with rapidly developed high-technology, watches are still very popular for human beings. However, decorating elements in a traditional watch are usually directly attached onto the strap or the body, thus causing a deficiency that the decorating element may not be replaced. Such watches have very simple decorating functions, and are not competitive in the market.

SUMMARY OF THE PRESENT DISCLOSURE

In viewing thereof, the present disclosure is directed to solve at least one of the problems existing in the prior art. Accordingly, a watch with replaceable decorating element is provided. The watch according to the present disclosure may have very simple elements and combination structures. The replacement of each element, especially for the decorating element, may be simplified, and the decorating functions of the watch may be improved accordingly.

According to an aspect of the present disclosure, a watch with a replaceable decorating element is provided. The watch may comprise a body and a strap. The strap may comprise a first through hole. A decorating substrate may be provided on an upper surface of the strap and a snap ring may be provided below a lower surface of the strap, in which the decorating substrate and the snap ring may be attached correspondingly with the first through hole. The decorating substrate may comprise a second through hole connected with the first through hole coaxially. The body may be installed into the first and second through holes. An upper surface of the body may comprise an extending edge, and the extending edge may be attached on an upper edge of the second through hole in the decorating substrate. The body may comprise a bottom end extending through the first through hole and reaching outside the lower surface of the strap. The bottom end of the body may be provided with an external thread. The snap ring may form a thread connection with the bottom end and be attached below a lower edge of the first through hole in the strap.

According to the present disclosure, the watch disclosed may provide many advantages and benefits. To be detailed, the present disclosure provides a watch whose body can be assembled on (or disassembled from) the strap through the snap ring. Also, a decorating substrate is mounted with the strap, so that the dismounting of each part of the watch is very simple. In addition, it is convenient for users to replace the decorating substrate with other ornamentals having different shapes and functions. Thus, changes on the style or appearance of the watch can be achieved. In that way, optional DIY and creative designs can be obtained, and personal requirements especially for the young people, can be well satisfied.

Further embodiments of the invention could be learned from the claims and the following description of the invention.

BRIEF DESCRIPTION OF THE DRAWINGS

These and other aspects and advantages of the present disclosure will become apparent and more readily appreciated from the following descriptions taken in conjunction with the drawings in which.

DETAILED DESCRIPTION OF THE EMBODIMENT

Figure 1:
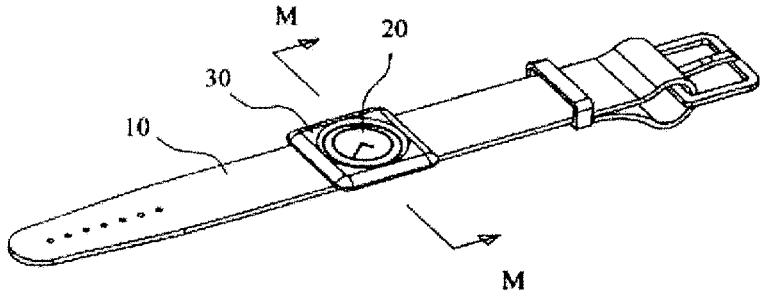
FIG. 1 shows an assembled watch according to an embodiment of the present disclosure.

Reference will be made in detail to embodiments of the present disclosure. The embodiments described herein are explanatory, illustrative, and used to generally understand the present disclosure. The embodiments shall not be construed to limit the present disclosure. The same or similar elements and the elements having same or similar functions are denoted by like reference numerals throughout the descriptions.

According to an aspect of the present disclosure, a watch with a replaceable decorating element is provided. The watch may comprise a body and a strap. The strap may comprise a first through hole. A decorating substrate may be provided on an upper surface of the strap and a snap ring may be provided below a lower surface of the strap, in which the decorating substrate and the snap ring may be attached correspondingly with the first through hole. The decorating substrate may comprise a second through hole connected with the first through hole coaxially. The body may be installed into the first and second through holes. An upper surface of the body may comprise an extending edge, and the extending edge may be attached on an upper edge of the second through hole in the decorating substrate. The body may comprise a bottom end extending through the first through hole and reaching outside the lower surface of the strap. The bottom end of the body may be provided with an external thread. The snap ring may form a thread connection with the bottom end and be attached below a lower edge of the first through hole in the strap.

In an embodiment, the first through hole may be round. Two first restricting planes may be formed symmetrically on an inner wall of the first through hole. The body may be provided with a cylindrical shape accordingly. Two second restricting planes may be formed correspondingly on an outside wall of the body. The first restricting plane and the second restricting plane may form a surface connection with each other.

In an embodiment, the decorating substrate may be formed by a jadestone. In an embodiment, a cross section of the decorating substrate may have a shape selected from the group consisting of: square, rectangle, roundness, heart-shape, pentagram, quincunx, eye-shape, hexagon, triangle, and ellipsoid.

In an embodiment, an upper edge of the second through hole in the decorating substrate may form an inclined plane inclining toward the interior of the second through hole. The extending edge of the body may be attached on the inclined plane, providing an upper surface of the body lower than an upper surface of the decorating substrate.

Example 1

Figure 2:
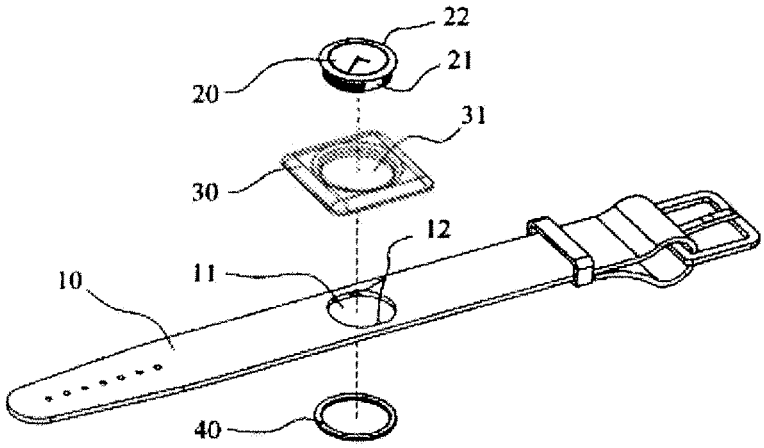
FIG. 2 shows elements of a disassembled watch according to an embodiment of the present disclosure.
Figure 3:
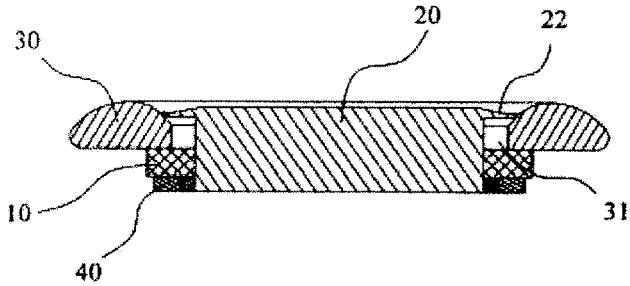
FIG. 3 is a cross-sectional view through line M-M of the watch in FIG. 1.
Figure 4:
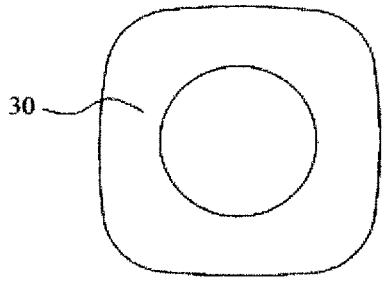
FIG. 4 is a projection view of a square decorating substrate according to an embodiment of the present disclosure.
Figure 5:
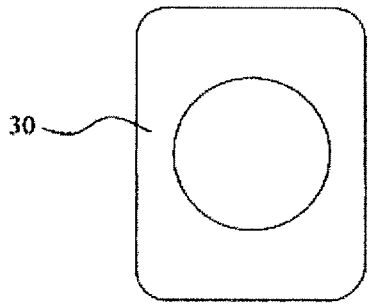
FIG. 5 is a projection view of a rectangular decorating substrate according to an embodiment of the present disclosure.
Figure 6:
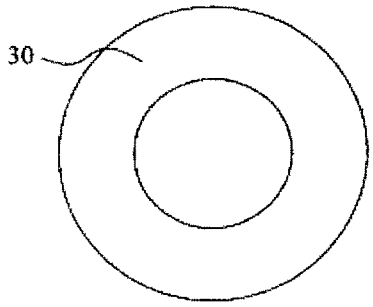
FIG. 6 is a projection view of a round decorating substrate according to an embodiment of the present disclosure.
Figure 7:
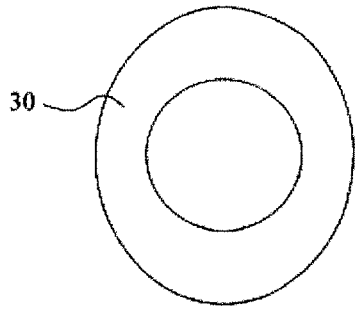
FIG. 7 is a projection view of an eye-shaped decorating substrate according to an embodiment of the present disclosure.
Figure 8:
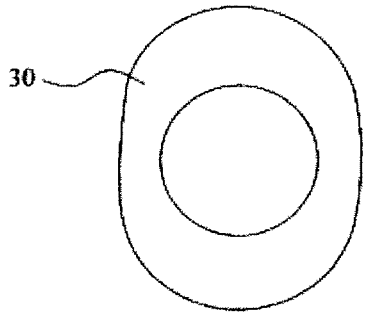
FIG. 8 is a projection view of an elliptical decorating substrate according to an embodiment of the present disclosure.
Figure 9:
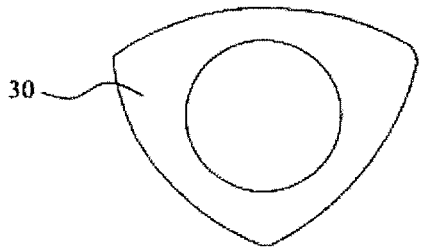
FIG. 9 is a projection view of a triangular decorating substrate according to an embodiment of the present disclosure.
Figure 10:
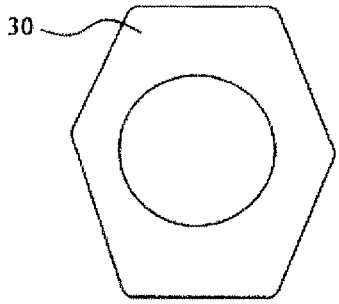
FIG. 10 is a projection view of a hexagonal decorating substrate according to an embodiment of the present disclosure.
Figure 11:
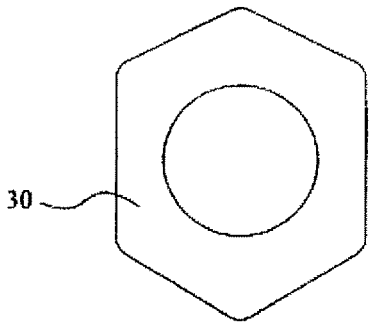
FIG. 11 is a projection view of a rhombic decorating substrate according to an embodiment of the present disclosure.
Figure 12:
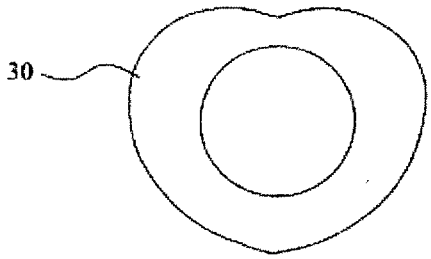
FIG. 12 is a projection view of a heart-shaped decorating substrate according to an embodiment of the present disclosure.
Figure 13:
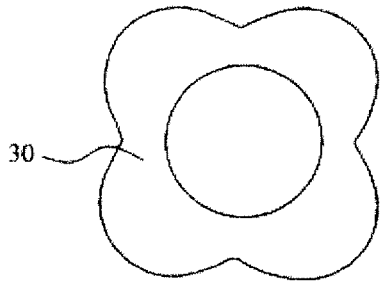
FIG. 13 is a projection view of a quincuncial decorating substrate according to an embodiment of the present disclosure; where the strap is denoted by 10; the first through hole is denoted by 11; the first restricting plane is denoted by 12; the body is denoted by 20; the second restricting plane is denoted by 21; the extending edge is denoted by 22; the decorating substrate is denoted by 30; the second through hole is denoted by 31; and the snap ring is denoted by 40.

As shown in FIGS. 1-3, detailed structure of a watch according to an embodiment of the present disclosure is provided. The watch comprises a strap 10, a body 20, a decorating substrate 30, and a snap ring 40.

The strap 10 is formed with a first through hole 11. The first through hole 11 is round, and two first restricting planes 12 are provided symmetrically on an inner wall of the round first through hole 11.

The decorating substrate 30 is formed on an upper surface of the strap 20. The decorating substrate 30 comprises a second through hole 31 coaxially connected with the first through whole 11. A diameter of the second through hole 31 is greater than that of the first through hole 11.

The body 20 is installed into the first through hole 11 and the second through hole 31. The boy 20 has a cylindrical shape. Two second restricting planes 21 are formed on an outside wall of the cylindrical body 20. The second restricting plane 21 forms a surface connection with the first restricting plane 12, thus preventing the body 20 from sliding or rotating in the first through hole 11. An upper end of the body 20 comprises an extending edge 22, and the extending edge 22 is attached on the upper edge of the second through hole 31 in the decorating substrate 30. In an embodiment, the upper edge of the second through hole 31 forms an inclined plane inclining toward the interior of the second through hole 31. The extending edge 22 of the body 22 is attached onto the inclined plane, providing the upper surface of the body 20 lower than the upper surface of decorating substrate 30. In that way, a watch with flat front and side surfaces can be obtained. The body 20 comprises a bottom end extending through the first through hole 11 and reaching outside the lower surface of the strap 10. The bottom end of the body has a surface formed with an external thread.

The snap ring 40 forms a thread connection with the bottom end of the body 20, and is attached below the lower edge of the first through hole 11 in the strap 10. The thread connection provides a connection force to fix the body 20 with the strap 10.

In an embodiment, the decorating substrate 30 may be preferable formed by a jadestone in order to provide jade ornaments on the watch. As shown in FIGS. 3-14, projection views of the decorating substrate 30 may have a shape selected from the group consisting of: square, rectangle, roundness, eye-shape, ellipse, triangle, hexagon, rhomb, heart-shape, and ellipse. Any shape with aesthetic appearances or designs may be applied here, and the shape can also be adjusted according to requirements in the practical use.

In an embodiment, the watch is assembled in a method comprising the following steps. First a decorating substrate 30 with a predetermined shape is provided. The decorating substrate is attached on the upper surface of the strap 10, with the first through hole 11 in the strap 10 coaxially facing with the second through hole 31 in the decorating substrate 30. Then the bottom end of the body 20 is put through the second through hole 31 and the first through hole 11 from up to bottom, until the extending edge 22 on the upper end of the body 20 attached on the upper surface of the decorating substrate 30 and the bottom end of the body reaching outside the lower surface of the strap 10. Finally, the snap ring 40 is locked with the bottom end of the body 20 until the strap 10 is clamped tightly in a way of forming a thread connection between the body 20 and the snap ring 40. When the watch is disassembled, the snap ring 40 is rotated in a direction opposite with the former direction of forming the thread connection, in order to loosen the snap ring 40, then the body 20 and the decorating substrate 30 can be took away and replaced.

Additional aspects and advantages of the embodiments of the present disclosure will be given in part in the following descriptions, become apparent in part from the following descriptions, or be learned from the practice of the embodiments of the present disclosure. Although the present disclosure have been described in detail with reference to several embodiments, additional variations and modifications exist within the scope and spirit as described and defined in the following claims.

What is claimed is:

1. A watch with a replaceable decorating element, comprising a body (20) and a strap (10), wherein: the strap (10) comprises a first through hole (11); a decorating substrate (30) is provided on an upper surface of the strap (10) and a snap ring (40) is provided below a lower surface of the strap (10), in which the decorating substrate (30) and the snap ring (40) are attached correspondingly with the first through hole (11); the decorating substrate (30) comprises a second through hole (31) coaxially connected with the first through hole (11), and the body (20) is installed into the first thorough hole (11) and the second through hole (31); the body (20) comprises an extending edge (22) on an upper surface thereof, the extending edge (22) is attached above an upper edge of the second through hole (31) in the decorating substrate (30), the body (20) further comprises a bottom end extending through the first through hole (11) and reaching outside the lower surface of the strap (10), the bottom end of the body (20) comprises an external thread on a surface thereof, and the snap ring (40) forms a threaded connection with the bottom end and is attached with a lower edge of the first through hole (11) in the strap (10).

2. The watch according to claim 1, wherein the first through hole (11) is round, and two first restricting planes (12) are provided symmetrically on an inner wall of the first through hole (11); the body (20) has a cylindrical shape accordingly, and two second restricting planes (21) are provided correspondingly on an outside wall of the body (20); and the first restricting plane (12) and the second restricting plane (21) forms a surface connection.

3. The watch according to claim 1, wherein the decorating substrate (30) is formed by a jadestone.

4. The watch according to claim 1, wherein a cross section of the decorating substrate (30) has a shape selected from the group consisting of: square, rectangle, roundness, heart-shape, eye-shape, pentagram, quincunx, hexagon, triangle, and ellipse.

5. The watch according to claim 1, wherein the upper edge of the second through hole (31) in the decorating substrate (30) forms an inclined plane inclining toward the interior of the second through hole (31); and the extending edge (22) is attached with the inclined plane, providing the upper surface of the body (20) lower than the upper surface of the decorating substrate (30).

* * * * *